United States Patent [19]

Kincaid

[11] 4,406,914

[45] Sep. 27, 1983

[54] SLOTLESS MULTI-SHIELDED CABLE AND TAPE THEREFOR

[75] Inventor: John W. Kincaid, Batavia, Ill.

[73] Assignee: Belden Corporation, Geneva, Ill.

[21] Appl. No.: 291,798

[22] Filed: Aug. 10, 1981

[51] Int. Cl.[3] ..... H01B 11/06

[52] U.S. Cl. ..... 174/107; 174/36; 174/109; 174/117 R; 174/117 FF

[58] Field of Search ..... 174/36, 107, 109, 117 FF, 174/117 R, 115

[56] References Cited

U.S. PATENT DOCUMENTS

| | | | |
|---|---|---|---|
| 3,051,771 | 8/1962 | Lee | 174/36 |
| 3,439,111 | 4/1969 | Miracle | 174/107 |
| 3,459,877 | 8/1969 | Bullock | 174/36 |
| 3,624,267 | 11/1971 | Plummer | 174/36 |
| 3,662,090 | 5/1972 | Grey | 174/36 X |
| 3,971,879 | 7/1976 | Rosenburg | 174/36 |
| 4,092,452 | 5/1978 | Hori | 174/107 X |
| 4,125,739 | 11/1978 | Bow | 174/36 |
| 4,297,522 | 10/1981 | Jesse et al. | 174/117 FF X |
| 4,323,721 | 4/1982 | Kincaid | 174/36 |
| 4,327,246 | 4/1982 | Kincaid | 174/107 |

FOREIGN PATENT DOCUMENTS

| | | | |
|---|---|---|---|
| 2726168 | 12/1978 | Fed. Rep. of Germany | 174/107 |

*Primary Examiner*—A. T. Grimley
*Assistant Examiner*—Morris H. Nimmo
*Attorney, Agent, or Firm*—Fitch, Even, Tabin & Flannery

[57] ABSTRACT

A multi-shielded transmission cable has no "slots" in the shielding so that signal attenuation and distortion are minimized. A shielding tape for the ready manufacture of the cable has at least one conducting layer and an insulating layer and is folded at or near its longitudinal median. When the tape is wrapped about a cable core, the ends of the tape overlap so as to effect physical and electrical contact thereby avoiding slots. A heat-sensitive adhesive strip may be applied to the tape so that the shielding is bonded to the core during the step of extruding a protective jacket over the shielding tape.

7 Claims, 8 Drawing Figures

SLOTLESS MULTI-SHIELDED CABLE AND TAPE THEREFOR

BACKGROUND OF THE INVENTION

The present invention relates to a shielded cable and a tape for constructing the same.

The design requirements for information transmission cables, such as CATV cables include: low signal loss, shielding from extraneous electrical fields, cable flexibility and susceptibility to economical manufacture. Often, when it is desired to transmit high frequency signals, especially television signals, with a low loss, shielded cables are employed. A shielded cable usually includes a core of one or more insulated conductors enclosed within at least one conducting layer. The shielding resists signal leakage from the core and eliminates or reduces the interfering effects of extraneous electrical fields.

In order to provide flexibility, prior shielded cables have utilized a braided outer conductor or shield of copper or similar conductive material. However, braided shields, because of the spaces between the wire braids have the disadvantage of providing less than 100% coverage of the cable core. The effectiveness of a braided shield may be increased by more fine braiding or by a double layer of braid. Unfortunately, such expedients frequently result in the cable being excessively stiff, large or heavy; such a shield may be difficult to cut and terminate in a suitable electrical connection. Moreover, the greater amount of material required in such a construction increases the cost of the cable.

It is more economical to construct a cable by wrapping flexible tape with a conducting layer about an insulated conductor core. The tape may be wound helically about the core or wrapped longitudinally. It is highly desirable to provide double or multiple shielding to better retain signals transmitted by the core and insulate the core from extraneous signals and to provide backup shielding should one of the layers rupture by flexing of the cable or otherwise. Since it lacks the spaces inherent in a braiding, a tape provides very effective shielding, stopping signals which would frequently leak through a braided shield.

It is desirable that the conducting layer or layers of the tape be quite thin to minimize expense, stiffness and bulk. However, very thin conducting layers do not have the strength and durability required in most applications for flexible cables. Therefore, it is convenient to provide a backing for the thin conducting layer to enhance its integrity. Thus, tapes are currently manufactured with a conducting layer over a backing or with a strength-giving layer sandwiched between two conducting layers. Such tapes are relatively inexpensive and convenient to handle.

The dielectric character of most suitable backing materials causes a problem in completing electrical shields using these tapes. If layered shielding tape is wound around a cable so that the ends overlap, the backing prevents a conducting layer from contacting itself in the region of overlap. This failure of contact leaves an electrical gap or slot in the shielding which permits signal leakage to and from the core. The resulting power loss and signal interference is referred to as the "slot effect".

One method of dealing with the slot effect is to fold back an edge of the tape in the region of overlap so as to permit a conducting layer to touch itself and thereby close the slot. However, there are several disadvantages to this approach. When it is used with tape having a single conducting layer, the approach does not provide multiple shielding. Thus, if the cable cracks due to flexing or other causes, the effectiveness of the shielding is greatly reduced. In the case of a tape with two conducting layers sandwiching an insulating layer, this method may fail to provide a ground connection between the conducting layers. The lack of such a ground connection makes it necessary to create more complex connections during cable termination or hook-up; otherwise, the advantages of the multi-shielding are lost. Furthermore, the narrow folded edge is difficult to handle reliably during manufacture and termination of the cable. Additionally, the narrow folded edge creates a longitudinal lump along the cable which is much stiffer than the neighboring areas; the stiffness differential on both sides of the lump increases the vulnerability of the shielding to rupture during flexing.

A more effective method of dealing with the slot effect is to provide one or more drain wires upon the periphery of the tape as disclosed in U.S. Pat. No. 3,927,247. However, such cable requires additional materials and manufacturing steps during cable manufacture, thus adding to the bulk of the cable and to manufacturing costs. In the case of the tape with two conducting layers, the disclosed drain wires would leave a slot in the inner of two conducting shields. Finally, the disclosed drain wire approach is not directly applicable to more than two layers of shielding.

SUMMARY OF THE INVENTION

In accordance with the present invention a shielding tape for shielding a cable is presented. The present invention also relates to a shielded cable employing such a tape. A tape having a conducting layer and an insulating layer is folded lengthwise so that the conducting layer enfolds the insulating layer. The fold defines two members, one of which, the "central" member, is positioned radially inwardly of the other, the "peripheral" member, when the tape is applied to a cable core in accordance with the present invention. The tape is folded so that the width of the central member is at least as great as the width of the peripheral member.

A cable constructed in accordance with the present invention applies such a folded tape over an insulated core; the width of each of the members of the tape is greater than the circumference of the core so that the tape overlaps itself when wrapped about the core. The resulting overlap of the tape effects a physical and electrical contact between the central and the peripheral members of the tape; the electrical contact eliminates the slot effect. The fold insures that the shielding will include a plurality of conducting layers. Thus, a cable with a more effective multi-shielding is provided.

In one of its aspects the present invention involves a tape with a second conducting layer on the side of the insulating layer opposite the enfolding conducting layer. This second conducting layer is enfolded by the enfolding conducting layer and the insulating layer. In this configuration the tape may be folded so that the central member is longer than the peripheral member. When this folded tape is wrapped about a cable core in accordance with the present invention, the enfolded conducting layer and the enfolding conducting layer make physical and electrical contact so as to effect a ground connection therebetween. This ground connection renders all conducting layers effective without complex terminating structures.

In accordance with more particular aspects of the present invention, adhesive may be applied between the core and the more central member of the folded tape. Core bonding prevents slippage between the shield and the core as otherwise might occur during cable termination or connection procedures. The adhesive also prevents damaging moisture from flowing between the core and the shield. A preferred manner of accomplishing the bonding is to form the tape with a heat-sensitive adhesive strip along the portion of the enfolding conducting layer that is part of the central member. The heat-sensitive adhesive strip must be spaced from the fold so that the physical and electrical contact of the tape members in the region of overlap is not interfered with. The adhesive may be activated by the heat from the process of extruding a protective jacket over the cable. Thus, no separate step is required during cable manufacture to effect core bonding. Additionally, lubricant may be applied between the members of the tape so as to facilitate relative movement and prevent galling such as may be induced when the cable is flexed.

Accordingly, a folded tape is disclosed which permits the economical manufacture of a multi-shielded core-bonded, slotless cable.

It is a primary object of the present invention to provide an improved cable shielding tape.

It is also a primary object of this invention to provide a cable with improved shielding.

Another object of the present invention is to provide an improved double-shielded cable with little or no slot effect.

It is still another object of the present invention to provide an improved multi-shielded cable with little or no slot effect wherein all layers of the conducting shield are electrically connected.

It is also an object of this invention to provide an improved shielding tape which conveniently may be used to manufacture a flexible, multi-shielded, slotless and core-bonded cable.

Other objects and features of the present invention are apparent in view of the following descriptions, drawings and claims.

DESCRIPTION OF THE PREFERRED EMBODIMENT

Figure 1:
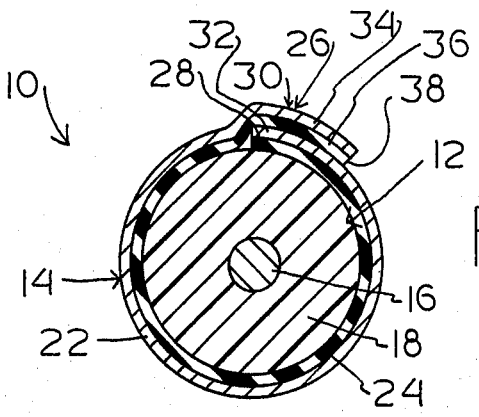
FIG. 1 PRIOR ART
FIG. 1 is a transverse sectional view of a prior art cable.

The present invention is concerned in part with eliminating the slot effect, which is now explained in connection with a cable made in accordance with the prior art illustrated in FIG. 1. A shielded cable 10 is presented in cross section. The cable consists of a core 12 and a shielding tape 14. The core has a central conductor 16 and surrounding sheath 18. The shielding tape 14 is formed of a conducting layer 22 and an insulating layer 24. The tape 14 is wrapped about the core 12 so as to overlap itself in an overlapping region 26. Within the overlapping region 26 are two ends of the tape 14: underlying end 28 and overlaying end 30. It is apparent that the conducting layer 32 of the underlying end is spaced apart from the conducting layer 34 of the overlaying end by the insulating layer 36 of the overlaying end. This spacing defines a slot 38 in the conductive shielding. This slot can allow extraneous signals to leak through the shielding and distort the signals transmitted in the core and allow transmitted signals to escape so as to weaken the transmission.

In accordance with the present invention an improved cable and an improved shielding tape for manufacturing the cable are presented whereby this slot effect is mitigated. There are two preferred embodiments of the present invention disclosed below, each characterized by a cable and a shielding tape suitable for the convenient manufacture of the corresponding cable. The first preferred embodiment utilizes a tape 104 (shown in FIGS. 4 and 5) with a single conducting layer 110 bonded to a strength-giving insulating layer 112 to manufacture a slotless double-shielded cable 100 (shown in FIGS. 2 and 3). The second preferred embodiment employs a tape 210 (shown in FIG. 6) having two conducting layers 212 and 214 sandwiching an insulating layer 216 to manufacture a slotless multi-shielded cable 200 (shown in FIGS. 7 and 8). The tape 210 of the second preferred embodiment is offset folded so that the two conducting layers 212 and 214 are mutually grounded when the tape is applied to a cable core in accordance with the present invention. These two preferred embodiments will now be described in greater detail.

Figure 2:
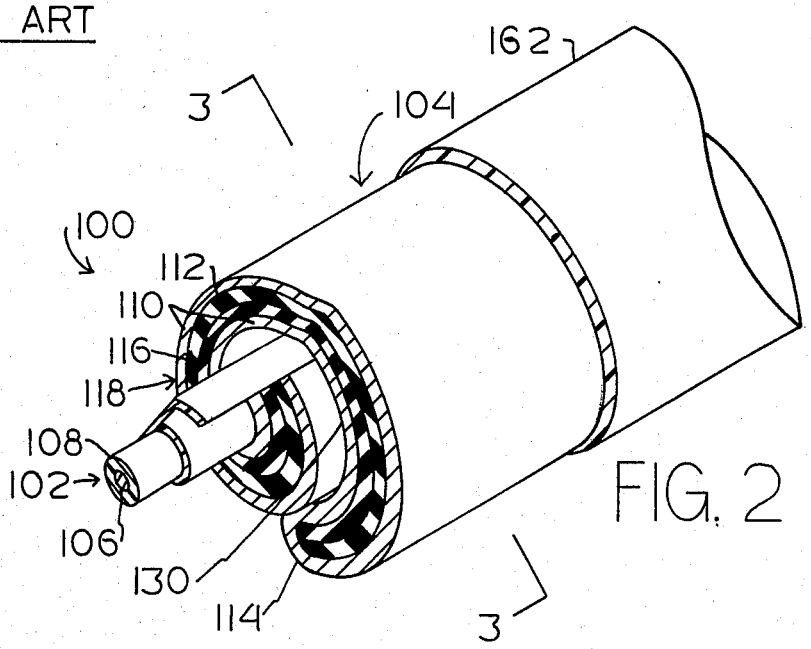
FIG. 2 is a perspective view with portions cut away of a cable in accordance with a first preferred embodiment of the present invention.
Figure 3:
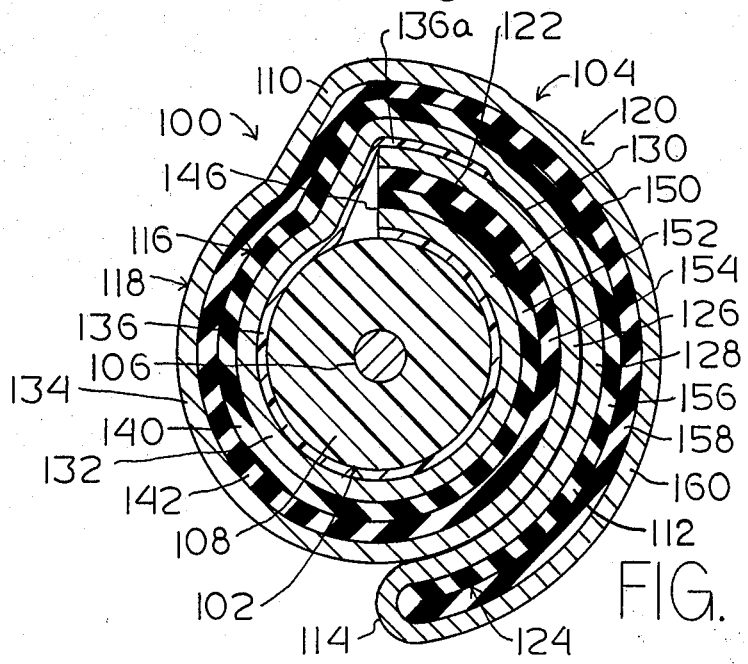
FIG. 3 is a sectional view taken along line 3—3 of FIG. 2.

The cable 100 of the first preferred embodiment of the present invention is illustrated in perspective in FIG. 2 and in cross section in FIG. 3, and comprises an insulated core 102 with shielding tape 104 wrapped therearound. The tape 104, which comprises an enfolding conducting layer 110 and an insulating layer 112, surrounds the core. The core 102 consists of a conductor 106 and an insulating sheath 108. The tape 104 is folded along its longitudinal median to create a fold 114 which defines a radially inward or "central" member 116 and a radially outward or "peripheral" member 118, when the tape is wrapped about the core. The folded tape 104 overlaps itself in an overlapping region 120. The resulting overlapping region 120 defines an underlying end 122 and an overlaying end 124. The overlaying end 124 contains the fold 114.

Within the region of overlap 120 the conducting layer 110 on the peripheral member 118 of the underlying end 122, the "underlying peripheral conductor" 126, is in physical and electrical contact with the conducting layer 110 of the central member 116 of the overlaying end 124, the "overlaying central conductor" 128. This contact, effected along metal-to-metal interface 130, mitigates or eliminates the slot effect, for if one traces the conducting layer 110 it will be seen to have completely surrounded the core 102 and provides a double metal layer about the core 102, resulting in a double-shielding for the cable 100.

Adhesive 136 between the core 102 and the central member 116 of the folded tape 104 flexibly bonds the shielding tape 104 to the core. The bonding facilitates cable connection and termination, and impedes moisture progression along the core surface.

In accordance with the present invention, a shielding with at least two conducting layers about a core and without a slot effect is provided in a simple and inexpensive manner. This is achieved by providing a novel folded tape 104 having a shielding enfolding conducting layer 110 (FIG. 5) and an insulating layer 112 with an adhesive 136 in the form of a heat-sensitive strip extending longitudinally along a portion of the conducting layer 110 for later adhesion to the core 102. The adhesive layer 136 will bond the shielding tape 104 to the core 102 as shown in FIGS. 2 and 3. Preferably, the adhesive 136 is of sufficient lateral extent that an adhesive section **136*a* thereof (FIG. 3) will also adhere to a longitudinally extending leaved edge 146 of the tape 104 (the edge opposite the folded edge) while the metal layers 126 and 128** are in contact to ground the tape edges and eliminate the slot effect.

Figure 4:
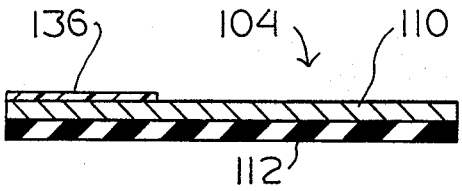
FIG. 4 is a transverse sectional view of a tape in accordance with a first preferred embodiment of the present invention.
Figure 5:
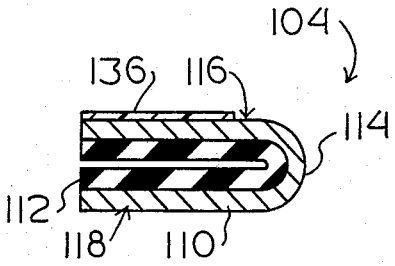
FIG. 5 is a transverse sectional view of a folded tape in accordance with the first preferred embodiment of the present invention.

As explained hereinabove, the single conducting layer tape 104 is shown in FIG. 4 in its pre-folded condition. The tape comprises the upper conducting layer 110, preferably of aluminum, and the lower insulating layer 112, preferably of polyester. To provide for the convenient bonding of the tape to the cable core 102, the tape further comprises a heat-sensitive adhesive strip 136 disposed lengthwise upon the conducting layer 110. The adhesive should be flexible enough so that relative movement between the core and shielding is permitted to avoid crimping and durable enough so that it does not deteriorate during repeated flexing. Ethyl acrylic acid (EAA) is one such adhesive. The width of the adhesive strip 136 is less than one half the width of the tape so that a portion of the overlapping region 120 has metal-to-metal contact at the shielding central member 116.

The fold 114 defines two members, one becoming the central member 116 and the other becoming the peripheral member 118 when the tape is wrapped upon a cable core 102 in accordance with the present invention. In the first embodiment, the fold 114 is along the longitudinal median of the tape so that the central member 116 and peripheral members 118 are of equal width. Necessarily, a central conducting layer 132 and a peripheral conducting layer 134 (FIG. 3) are defined by the fold, as are a central insulating layer 140 and a peripheral insulating layer 142. Lubricant (not shown) may be applied between the adjacent insulating layers 140 and 142 to facilitate flexing of the cable. The fold also results in the creation of a longitudinally extending leaved edge 146.

Referring in greater detail to FIGS. 2 and 3, a cable 100 is shown such as might be used in cable television (CATV) applications where high frequency transmissions require effective shielding. For expository reasons, the figures are not drawn to scale. The invention is applicable to other cable types, including those with cores having two or more insulated conductors. In the present embodiment, the core includes the conductor 106 and the insulating sheath 108. The shielding is constituted by the folded tape 104 which has a folded transverse width greater than the circumference of the core 102 so that the fold 114 and the leaved edge 146 of the tape overlap when the tape 104 is wrapped about the core 102. The region of overlap 120 preferably extends over 20% to 80% of the core circumference so as to avoid the creation of a narrow stiff region which might hasten the breakdown of the shielding. The leaved edge 146 is preferably overlaid and protected by the fold 114, which is less subject to fraying and other forms of disruption. Since the width of the adhesive strip 136 is slightly greater than the circumference of the core 102, the adhesive extends slightly into the region of overlap 120 at **136*a* so as to further inhibit fraying at the leaved edge 146**.

The structure as described above results in the following stratification of cable 100, starting at the center and extending radially outward and through the region of overlap: the core conductor 106, the core insulation 108, adhesive 136, the underlying central conductor 150, the underlying central insulation 152, lubricant (not shown), the underlying peripheral insulation 154, the underlying peripheral conductor 126, the overlaying central conductor 128, the overlaying central insulation 156, lubricant (not shown), the overlaying peripheral insulation 158, an overlaying peripheral conductor 160, and an extruded insulation jacket 162 (shown in FIG. 2).

A metal-to-metal interface 130 is achieved between underlying peripheral conductor 126 and overlaying central conductor 128 which are in physical and electrical contact over most of the region of overlap. This interface 130 contact closes the potential slot and thereb completes the shield so that negligible signal leakage occurs to or from the core. Thus, it can be seen that while adhesive 136 may extend between the ends in the region of overlap 120, it must not extend so far as to negate electrical contact between them.

Lubricant applied between adjacent insulating layers 152 and 154, and 156 and 158, facilitates flexing of the cable. The lubricant is most easily applied to the internal surface of the tape 104 prior to folding.

The adhesive 136 bonds the shielding tape 104 to the core 102 so that the two do not slip due to handling during connecting and terminating. The preferred adhesive, ethyl acrylic acid, remains flexible enough to allow flexing of the cable without deterioration and without causing crimping. The adhesive extends about the entire circumference to help prevent fraying of the leaved edge 146, but does not extend so far into the region of overlap 120 so as to prevent electrical contact therebetween. The adhesive is waterproof, preventing moisture from progressing along the length of the cable between the core and the shielding.

The cable of the first embodiment is simply and economically manufactured using the folded tape 104 of the first embodiment. The tape is wrapped circumferentially about the insulated core and, immediately thereafter, the wrapped core is passed through an extruder which applies the flexible jacket 162 to provide strength and integrity to the cable. Heat from the extrusion process activates the heat-sensitive adhesive strip on the tape 104, thereby effecting a bond between the core 102 and shielding 104 without additional steps.

The preferred dimensions for the cable are, in part, a function of the intended core 102. Contemplated cores range in from a 0.146" diameter core with a 0.032" diameter conductor to a 0.285" diameter core with a 0.090" diameter conductor 106. The case involving the 0.146" diameter core is considered herein. Given such a core, the tape of the preferred embodiment is 0.001" thick with an unfolded width of 1.5", which amounts to a 0.75" folded width. When wrapped around the core 102, the ends of the tape overlap 0.292" which is about 64% of the 0.458" circumference of the core 102. The adhesive strip 136 is 0.520" wide and adds 0.001" to the thickness of the tape. The adhesive 136 extends only 0.006" into the region of overlap so that the electrical and physical contact between the aluminum layers is not jeopardized. For expository reasons the figures are not drawn to scale.

Figure 6:
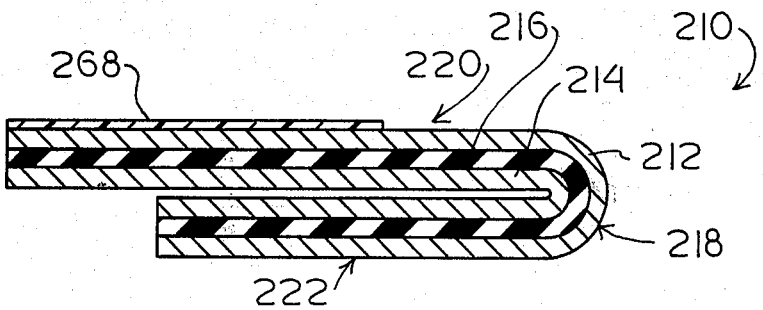
FIG. 6 is a transverse sectional view of a folded tape in accordance with a second preferred embodiment of the present invention.
Figure 7:
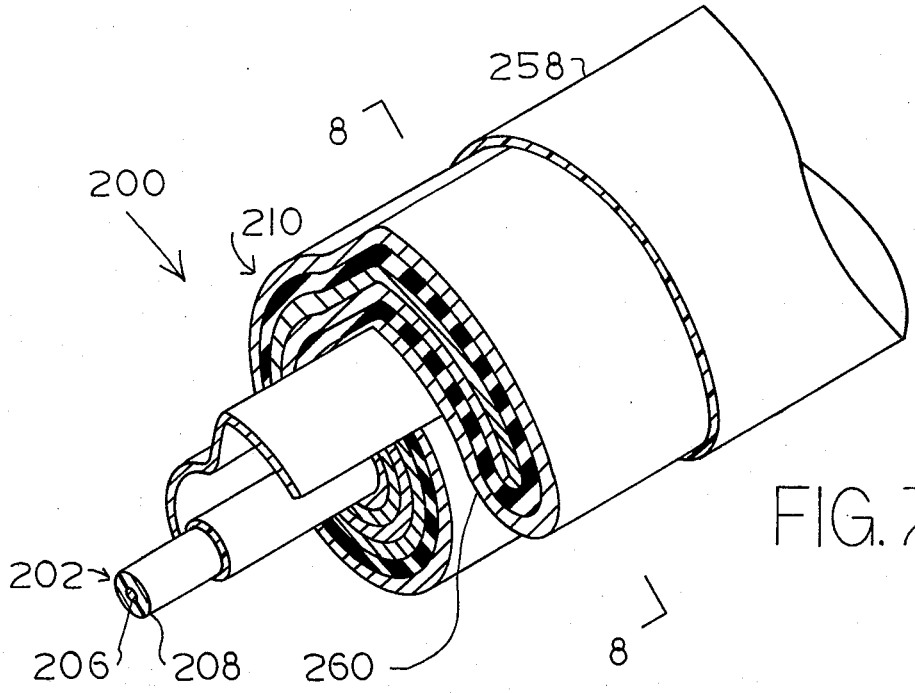
FIG. 7 is a perspective view with portions cut away of a cable in accordance with a second preferred embodiment of the present invention.
Figure 8:
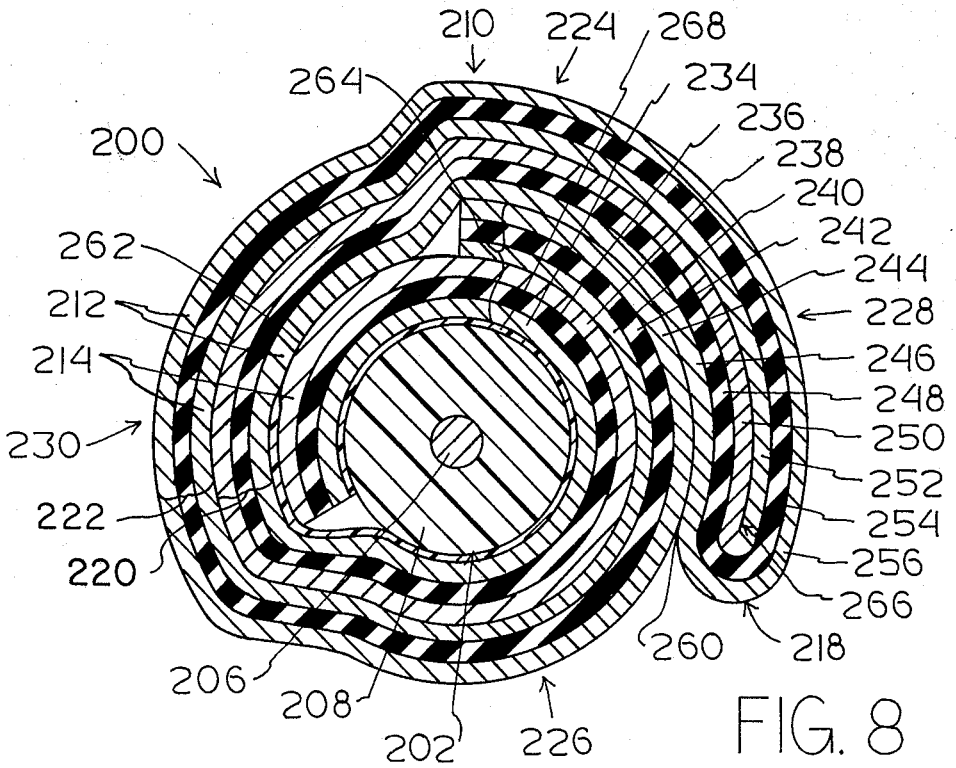
FIG. 8 is a sectional view taken along line 8—8 of FIG. 7.

A second preferred embodiment, shown in FIGS. 7 and 8, utilizes a three-layer tape 210 instead of the two-layer tape of the first preferred embodiment. Unlike the tape 104 of the first preferred embodiment, the tape 210 of the second preferred embodiment is offset folded so as to define a wider "central" member 220 and a narrower "peripheral" member 222 of the tape 210. As shown in FIG. 6, the three layer tape comprises an insulating layer 216 sandwiched between an enfolding conducting layer 212 and an enfolded conducting layer 214. Due to the offset folding, the enfolding is only partial.

When the tape is applied to the manufacture of a cable 200 in a manner similar to that described in connection with the first embodiment, the offset folding permits the mutual grounding of the enfolding and enfolded conducting layers 212, 214 so that a more effective shielding is provided. As in the first embodiment, a heat-sensitive adhesive strip 268 may be incorporated with the tape 210 so that the incorporating cable 200 may be core bonded.

Describing the second cable embodiment of the invention in greater detail, a cable 200, as shown in FIGS. 6, 7 and 8 has a core 202 with a shielding tape 210 extending longitudinally and wrapped circumferentially therearound. The core 202 includes a longitudinally extending conductor 206 and an insulating sheath 208. The shielding tape 210 has an enfolding conducting layer 212, an enfolded conducting layer 214, and an insulating layer 216 therebetween. A protective jacket 258 surrounds the shielding tape 210. The tape 210 has a fold 218 extending longitudinally defining a wider member and a narrower member: the wider or "central" member 220 is applied adjacent the core, and radially inward of the narrower or "peripheral" member 222.

The width of the peripheral member 222 is greater than the circumference of the core 202 so that the tape 210 overlaps itself so as to define an overlapping region 224 and a region of non-overlap 226 as shown in FIG. 8. Since the central member 220 is wider than the peripheral member 222, the region of overlap is subdivided into a region of full overlap 228 and a region of partial overlap 230. An underlying end 264 and an overlaying end 266 are defined in the region of overlap.

As best seen in FIG. 8, the cable is stratified along an outwardly directed radius through the region of full overlap 228 as follows: core conductor 206, core insulation 208, adhesive 268, underlying central enfolding conductor 234, underlying central insulation 236, underlying central enfolded conductor 238, lubricant (not shown), underlying peripheral enfolded conductor 240, underlying peripheral insulation 242, underlying peripheral enfolding conductor 244, overlaying central enfolding conductor 246, overlaying central insulation 248, overlaying central enfolded conductor 250, lubricant (not shown), overlaying peripheral enfolded conductor 252, overlaying peripheral insulation 254, overlaying peripheral enfolding conductor 256, and cable jacket 258 (shown in FIG. 6). The stratification of the region of partial overlap shares the above order, but lacks the first lubricant and the underlying peripheral layers 240, 242, and 244.

There are two critical metal-to-metal contacts in this second embodiment. The first is a slot-closing connection 260 attained in the region of full overlap 228 and is effected by the physical and electrical interface contact between underlying peripheral enfolding conductor 244 and overlaying central enfolding conductor 246. This slot-closing connection 260 eliminates the slot effect so that transmission attenuation and interference by extraneous electrical fields are minimized. The second critical metal-to-metal contact is a ground connection 262 between underlying central enfolded conductor 238 and overlaying central enfolding conductor 246. This connection occurs in the region of partial overlap 230 and ensures that the enfolded 214 and enfolding 212 conductors of the tape 210 are grounded together. This grounding is made possible by the offset folding of the tape.

Adhesive, such as ethyl acrylic acid, is applied between the core 202 and central enfolding conducting layer 212 so that the core 202 and shielding 210 will not slip relative to one another during termination or connection of the cable 200. The preferred adhesive is flexible enough to allow bending of the cable and sufficient relative movement between core 202 and shielding 210 to prevent crimping. The adhesive may extend into the region of partial overlap 230, but not so far as to interfere with the electrical contact between the enfolded 214 and enfolding 212 conductors in the region of partial overlap 230.

The cable of the second embodiment may be manufactured using the tape illustrated in FIG. 6, which comprises the enfolding conducting layer 212, the insulating or strength-giving layer 216 and the enfolded conducting layer 214. The tape is folded parallel to its longitudinal median so as to define the wider central member 220 and a narrower peripheral member 222. Preferably, the conducting layers 212, 214 are of aluminum, and the insulation 216 is polyester.

The heat-sensitive adhesive strip 268 extends longitudinally upon a radially inward portion of the enfolding surface of the central member 220 along a region spaced from the fold. The adhesive strip 268 may consist of ethyl acrylic acid which is flexible enough to endure normal cable flexing and is waterproof so as to seal the interstice between the core and the shielding from moisture penetration. Lubricant (not shown) may be applied between the members to facilitate flexing of the cable incorporating the tape.

The preferred dimensions of the tape are a function of the core diameter; the following figures are based on a cable built around a 0.146" diameter core 202 like that selected for the first embodiment. The unfolded tape is 1.4" wide and 0.003" thick. The tape is folded with a 0.20" offset so that the central member 220 is 0.80" wide and the peripheral member 222 is 0.60" wide. The adhesive strip 268 is 0.50" wide and adds 0.001" to the thickness of the tape 210. When the tape 210 is wrapped about the core, 75% of the 0.458" circumference is in the region of overlap 224: 44% of the circumference is in the region of partial overlap 230 leaving 31% in the region of full overlap 228. The 31% figure, equivalent to 0.20", is ample to assure the physical and electrical contact between the underlying peripheral enfolding conductor 244 and the overlaying central enfolding conductor 246 so that the slot effect is eliminated. Taking the adhesive into account, the width of the contact area between the underlying central enfolded conductor 238 and the overlaying central enfolding conductor 246 is 0.10" or 22% of the core circumference; this is ample to assure a ground connection between the enfolded 214 and enfolding 212 conducting layers of the tape 210.

To manufacture the cable 200 of the second preferred embodiment, the tape 210 of the second preferred embodiment is wrapped circumferentially upon the cable core 202. Immediately thereafter, the shielded core is passed through an extruder which applies the protective and flexible outer jacket 258. The heat from the extruding process activates the ethyl acrylic acid to form a durable and flexible bond between the core 202 and the shielding 210. This bond facilitates splicing and prolongs the flex life of the cable 200. The adhesive should not extend so as to interfere with the electrical and physical contacts in the region of overlap.

Thus, in accordance with the second preferred embodiment, a slotless multi-shielded cable is presented which is core bonded and easily manufacturable from a two conductor offset folded tape 210 with a heat-sensitive adhesive strip 268. The conducting layers 212, 214 of the shield 210 are connected electrically so that grounding problems are avoided. The completed shield blocks leakage of signals to and from the cable core 206 to minimize signal distortion and attenuation.

Hereinabove, and in accordance with the present invention, flexible, slotless cables, and tapes for making the same, are presented. In the first embodiment, a double-shielded cable 100 is presented that may be manufactured from a folded tape 104 having one conducting layer 110. In the second embodiment, a multi-shielded cable 200 is presented that may be manufactured from an offset folded two conductor tape 210: the offset folding allows for simple grounding of the two conducting layers 212, 214. The tapes and cable presented are easily and economically manufactured as indicated. Both embodiments include provisions for core bonding to provide for more assured handling during connecting and terminating of the cable and to block moisture passage between the core and the shield.

Many variations upon the above embodiments are possible. The tape may be wound helically rather than be wrapped circumferentially. The adhesive in the cable may be derived other than from a heat-sensitive strip on the tape. Conducting lubricants may be applied between adjacent conducting layers. It is contemplated that different materials and dimensions may be used. Other variations are possible which remain within the spirit and scope of the present invention.

What is claimed is:

1. A tape for shielding the conductive core of an electrical cable comprising: a strip folded together along its length so as to define a first member and a second member, the first member having the same width as the second member, the folded strip having an enfolding conductive layer and an enfolded insulating layer, the conductive layer being substantially coextensive with the insulating layer to extend over substantially all of the exposed areas of the folded first and second members; and an adhesive extending over a longitudinal region spaced from the fold and along a portion of the enfolding conductive layer which is part of the first member.

2. A tape for shielding the conductive core of an electrical cable comprising: a strip folded together along its length so as to define a first member and a second member, the first member being substantially wider than the second member, the folded strip having an enfolding conducting layer, an enfolded conducting layer, and an enfolded insulating layer therebetween, the enfolding and enfolded conductive layers being substantially coextensive with said insulating layer on opposite sides thereof to provide a conductive layer extending over substantially all of the exposed areas of the folded first and second members; and an adhesive extending over a longitudinal region spaced from the fold and along a portion of the enfolding conducting layer which is part of the first member.

3. The tape of either one of claims 1 and 2 further comprising lubricant between the first and second members.

4. The tape of either one of claims 1 and 2 further characterized in that the adhesive is heat sensitive.

5. A tape for shielding the conductor of an electrical cable comprising:

a strip folded together along its length so as to define a wider member and a narrower member, the folded strip having aluminum enfolding and enfolded conductive layers and a polyester insulating layer therebetween, the enfolding and enfolded conductive layers being substantially coextensive with the insulating layer to provide a conductive layer extending over substantially all of the exposed areas of the folded wider and narrower members;

a lubricant between the wider and the narrower members; and a heat-sensitive adhesive upon the enfolding conductive layer of the wider member along a longitudinally extending region thereof spaced from the fold.

6. A shielded electrical cable comprising:

a core having a longitudinally extending conductor and insulation surrounding said conductor;

folded tape having a longitudinally extending fold defining a more central member and a more peripheral member folded together, the more central member having the same width as the more peripheral member, said width being greater than the circumference of said core, said folded tape having an enfolding layer of conductive material and an enfolded insulating layer, the enfolding layer being substantially coextensive with the insulating layer to extend over substantially all of the exposed areas of the folded together central and peripheral members, said folded tape being wrapped around said core to form a region of tape overlap so that the portion of the enfolding layer of conductive material that is part of the more central member is in physical and electrical contact with the portion of the enfolding layer of conductive material which is part of the more peripheral member;

adhesive extending between said core and the portion of said enfolding layer of conductive material that is part of the more central member so as to effect a bond therebetween and so as to leave intact the physical and electrical contact between the portion of said enfolding layer of conductive material that is part of the more central member and the portion of said enfolding layer of conductive material that is part of the more peripheral member; and an outer jacket disposed circumferentially and longitudinally over the portion of the enfolding layer of conductive material which is part of the more peripheral member.

7. A shielded electrical cable comprising:

a core having a longitudinally extending conductor and insulation surrounding the conductor;

folded tape having a longitudinally extending fold defining a more central member and a more peripheral member folded together, the more central member being substantially wider than the more peripheral member, at least one of said members having a width greater than the circumference of the core, the folded tape having an enfolding layer of conductive material, an enfolded conductive layer, and an enfolded insulating layer, the enfolding and enfolded conductive layers being substantially coextensive with the enfolded insulating layer to provide a conductive layer extending over substantially all of the exposed areas of the folded together central and peripheral members, said folded tape being wrapped around said core to form a region of tape overlap so that the portion of the enfolding layer of conductive material that is part of the more central member is in physical and electrical contact with the portion of the enfolding layer of conductive material which is part of the more peripheral member, and the enfolded layer of conductive material is in physical and electrical contact with the enfolding layer of conductive material in the region of tape overlap;

adhesive extending between said core and the portion of said enfolding layer of conductive material that is part of the more central member so as to effect a bond therebetween and so as to leave intact the physical and electrical contact between the portion of said enfolding layer of conductive material that is part of the more central member and the portion of said enfolding layer of conducting material that is part of the more peripheral member; and an outer jacket disposed circumferentially and longitudinally over the portion of the enfolding layer of conductive material which is part of the more peripheral member.

* * * * *